US007347496B1

(12) United States Patent
Wang

(10) Patent No.: US 7,347,496 B1
(45) Date of Patent: Mar. 25, 2008

(54) ADJUSTABLE CHAIR BACKREST

(76) Inventor: Chih Chiang Wang, 2F, No. 3, Lane 280, Chung-Chan Road, Hsin Tien City, Taipei Hsien (TW)

( * ) Notice: Subject to any disclaimer, the term of this patent is extended or adjusted under 35 U.S.C. 154(b) by 0 days.

(21) Appl. No.: 11/764,290

(22) Filed: Jun. 18, 2007

(51) Int. Cl.
*A47C 1/024* (2006.01)

(52) U.S. Cl. ..... 297/383; 297/354.11; 297/301.7

(58) Field of Classification Search ..... 297/301.1, 297/301.5, 301.6, 301.7, 354.11, 362.12, 297/362.14, 378.12, 383
See application file for complete search history.

(56) References Cited

U.S. PATENT DOCUMENTS 2,272,980 A * 2/1942 McLellan et al. ..... 297/362.14
2,338,511 A * 1/1944 Harman ..... 297/383
2,692,012 A * 10/1954 Cramer ..... 297/298
4,655,503 A * 4/1987 Kamijo et al. ..... 297/238
5,288,130 A * 2/1994 Foster ..... 297/411.36
5,931,531 A * 8/1999 Assmann ..... 297/316
7,234,768 B2 * 6/2007 Manning ..... 297/94
7,261,368 B1 * 8/2007 Clausnitzer ..... 297/130

* cited by examiner

*Primary Examiner*—Peter R. Brown
(74) *Attorney, Agent, or Firm*—Schmeiser, Olsen & Watts

(57) ABSTRACT

A chair backrest adjusting mechanism includes a seat supporting frame, a backrest supporting arm, amount, a supporting arm cover, and a ball-shaped handle. The seat supporting frame is fixedly connected at a lower end to a base below a chair seat, and pivotally connected at an upper end to two pivot brackets at a lower end of the backrest supporting arm, which is further pivotally connected at an upper end to the mount on a rear side of a chair backrest. The supporting arm cover is fitly covered on the backrest supporting arm with upper and lower ends pivotally connected to the mount and the upper end of the seat supporting frame. A threaded rod is fixedly mounted in and turned via the ball-shaped handle to drive the backrest supporting arm to tilt forward or backward, and accordingly adjust the backrest to different positions relative to the chair seat.

1 Claim, 6 Drawing Sheets

ADJUSTABLE CHAIR BACKREST

FIELD OF THE INVENTION

The present invention relates to an adjustable chair backrest, and more particularly to a chair backrest adjusting mechanism mounted between a chair seat and a chair backrest for adjusting the chair backrest forward or rearward relative to the chair seat, so that the chair seat is adaptable in depth to fit both child and adult.

BACKGROUND OF THE INVENTION

With the quickly upgraded living standards in the modern society, people pay more attention to furniture that is more convenient and practical for use. Therefore, there are diversified chairs available in the market.

Chairs that are frequently found in general families usually include integrally formed backrest and seat, and the seat usually has a fixed size. When sitting in a correct position, a person's back is rested against the backrest with two shanks naturally extended downward perpendicularly to the thighs and two heels in contact with the ground. When a child sits on a chair having a relatively large seat with his back rested against the backrest, it would be impossible for the child's two shanks to naturally extend downward perpendicularly to the thighs and two heels to contact with the ground. The child would easily get sore waist and aching back when sitting on the chair in such a position. On the other hand, when the seat has a relatively small size, an adult sit thereon with back rested against the backrest might have two legs not well supported by the seat. The adult would soon have swollen and numb shanks when sitting on the chair in such a position over a long time. Since most chairs for generally families have only one fixed size, consumers have to pay more to purchase chairs of different sizes for different family members. This would inevitably increase the family expenditure and form an economical pressure to the family.

It is therefore tried by the inventor to develop an adjustable chair backrest to overcome the problem in the conventional fixedly-sized chairs for general families.

SUMMARY OF THE INVENTION

A primary object of the present invention is to provide a mechanism for adjusting a chair backrest forward or rearward relative to a chair seat, so that the chair seat is adaptable in depth to fit both child and adult.

To achieve the above and other objects, the chair backrest adjusting mechanism according to the present invention includes a seat supporting frame, a backrest supporting arm, a mount, a supporting arm cover, and a ball-shaped handle. The seat supporting frame is fixedly connected at a lower end to a base below a chair seat, and pivotally connected at an upper hollow open end to two pivot brackets at a lower end of the backrest supporting arm, which is further pivotally connected at an upper end to the mount being fixed to a rear side of a chair backrest. The supporting arm cover is fitly covered on the backrest supporting arm with upper and lower ends pivotally connected to the mount and the upper hollow open end of the seat supporting frame. A threaded rod is fixedly mounted in and turned via the ball-shaped handle to drive the backrest supporting arm to tilt forward or backward, and accordingly adjust the backrest to different positions relative to the chair seat, allowing the chair seat to have a reduced or an increased depth to fit a child or an adult, respectively.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
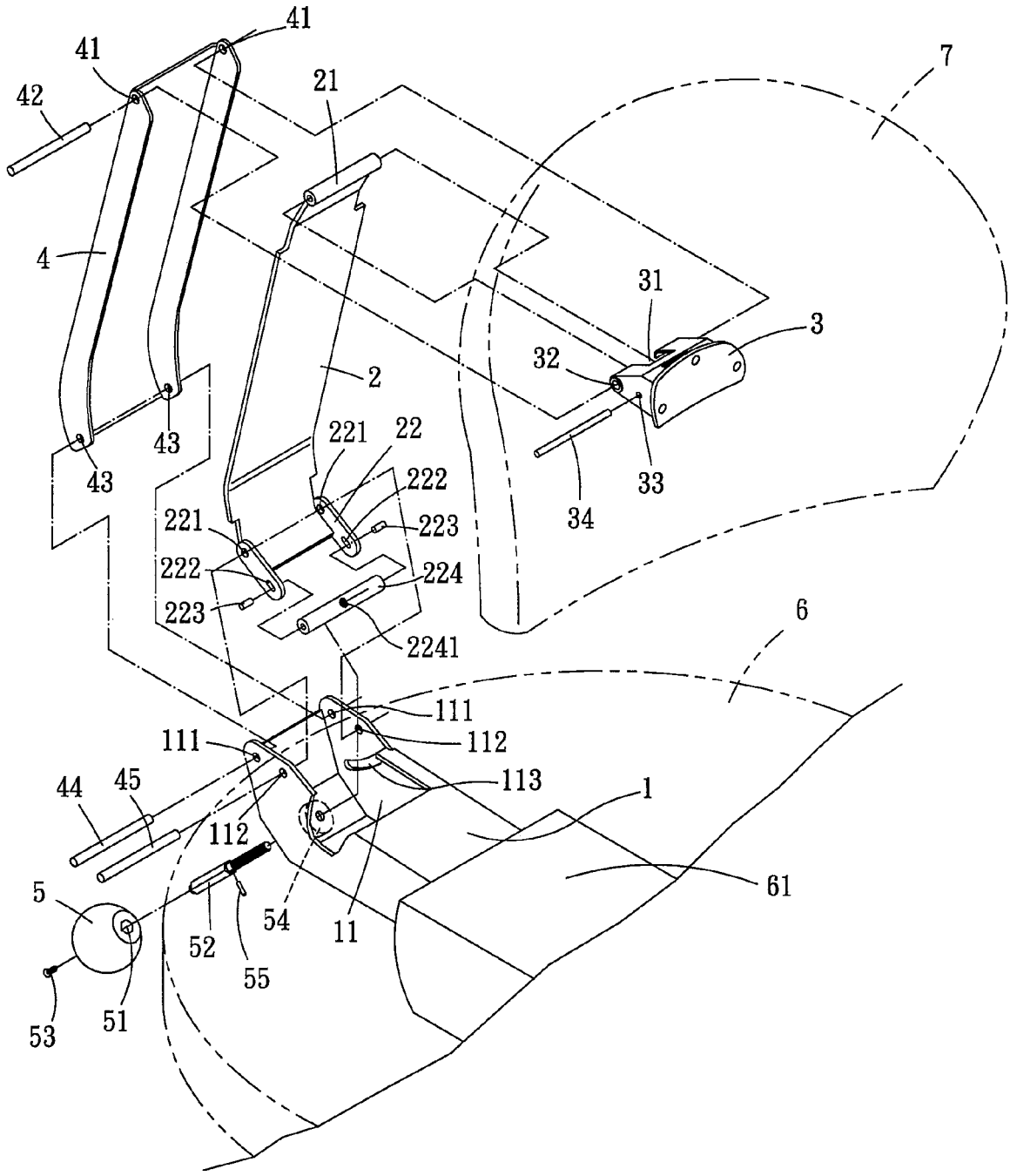
FIG. 1 is an exploded perspective view of an adjustable chair backrest according to the present invention.
Figure 2:
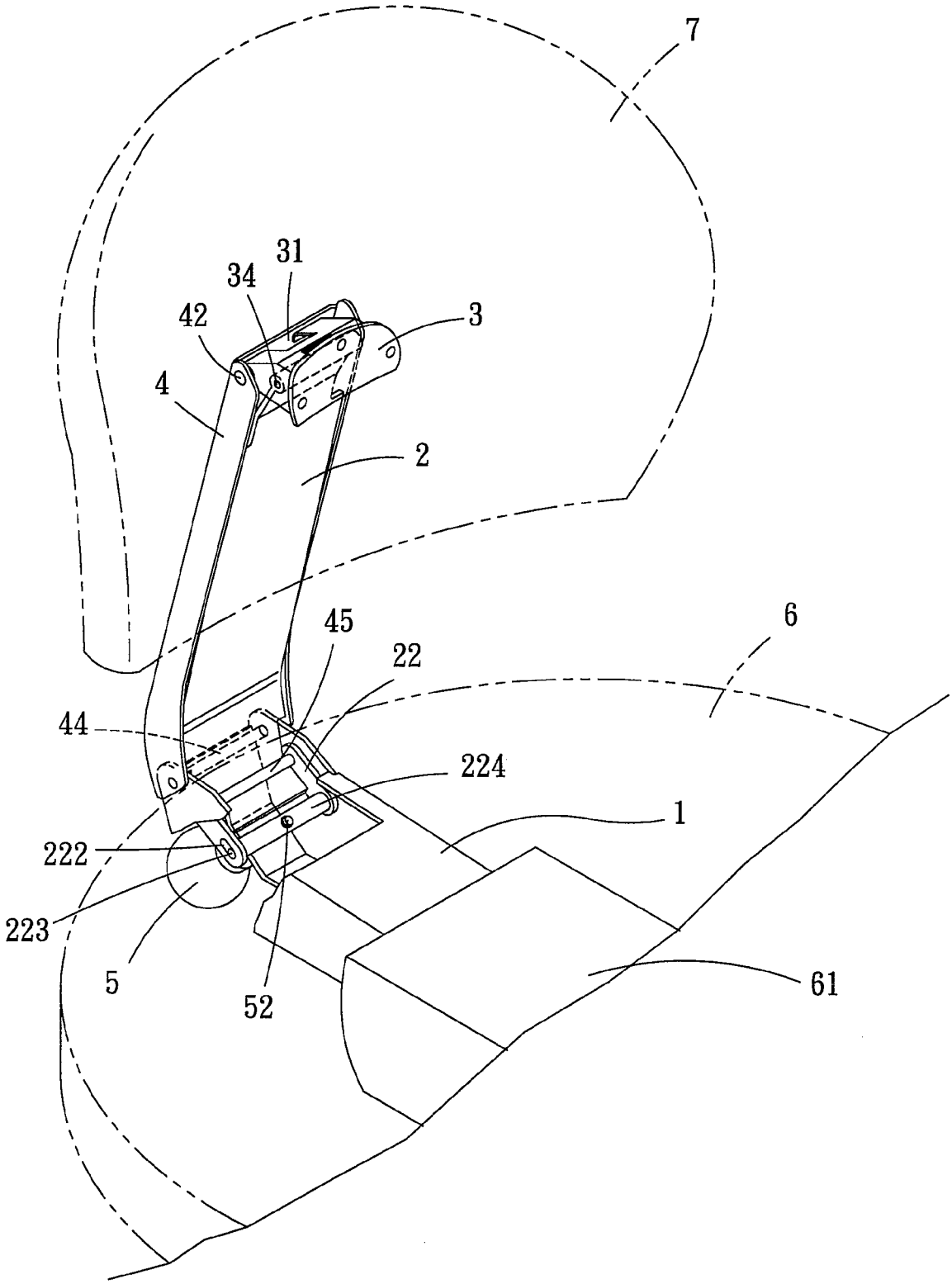
FIG. 2 is an assembled view of FIG. 1.

Please refer to FIGS. 1 and 2 that are exploded and assembled perspective views, respectively, of an adjustable chair backrest according to the present invention. As shown, the present invention includes a chair backrest adjusting mechanism mounted to and between a chair seat 6 and a chair backrest 7 for tilting the chair backrest 7 forward or rearward between a non-adjusted position and a forward-adjusted position relative to the chair seat 6. The chair backrest adjusting mechanism according to the present invention includes a seat supporting frame 1, a backrest supporting arm 2, a mount 3, a supporting arm cover 4, and a ball-shaped handle 5.

The seat supporting frame 1 is connected at a front end to a base 61 below the chair seat 6. A rear end of the seat supporting frame 1 is formed into a hollow opening 11 having two sidewalls. Two sets of shaft holes 111, 112 are correspondingly provided on the two sidewalls of the hollow opening 11 near upper edges thereof. And, on one of the two sidewalls, there is provided a curved long slot 113 located lower than the shaft holes 111, 112 on that sidewall.

The backrest supporting arm 2 has an upper end provided with a transverse tubular joint 21 for engaging with the mount 3, which is connected to a rear side of the chair backrest 7. A lower end of the backrest supporting arm 2 is a slightly bent section in a predetermined shape. Two pivot brackets 22 are correspondingly connected to and forward extended from two lateral sides of the bent section. The two pivot brackets 22 are provided with a shaft hole 221 and an oblong hole 222 each. Along shaft 45 is extended through the shaft holes 221 and the set of shaft holes 112 on the two sidewalls of the hollow opening 11, so that the two pivot brackets 22 are pivotally connected to the two sidewalls of the hollow opening 11 of the seat supporting frame 1. Meanwhile, two short pins 223 are extended through the two oblong holes 222 into two ends of a pivot shaft 224, so that the pivot shaft 224 is mounted to and between the two pivot brackets 22. The pivot shaft 224 is provided at a middle point with an internally threaded hole 2241.

The mount 3 is connected to a rear side of the chair backrest 7, and has an outer end formed with a recess 31. Two sidewalls of the recess 31 are correspondingly provided with a through hole 32 and a shaft hole 33 each. The shaft holes 33 are located behind the through holes 32. A long shaft 34 is extended through the two shaft holes 33 into the tubular joint 21 at the upper end of the backrest supporting arm 2.

The supporting arm cover 4 is configured to fitly cover the backrest supporting arm 2, and is correspondingly provided at two lateral sides of an upper end with a shaft hole 41 each. A long shaft 42 is extended through the two shaft holes 41 and the two through holes 32 at two sidewalls of the recess 31 of the mount 3 to thereby connect the supporting arm cover 4 to the mount 3. A lower end of the supporting arm cover 4 is a slightly curved section with two sidewalls thereof correspondingly provided with a shaft hole 43 each. A long shaft 44 is extended through the two shaft holes 43 and the other set of shaft holes 111 on the two sidewalls of the hollow opening 11 of the seat supporting frame 1 to thereby connect the supporting arm cover 4 to the seat supporting frame 1.

The ball-shaped handle 5 is provided for adjusting the chair backrest 7 forward or backward. The ball-shaped handle 5 is provided along an axis thereof with a central bore 51, in which an externally threaded rod 52 is mounted. A screw 53 is externally screwed into a rear end of the threaded rod 52 to hold the latter in the central bore 51. A front end of the threaded rod 52 is extended through a ring member 54 to mesh with the internally threaded hole 2241 on the pivot shaft 224 mounted between the two pivot brackets 22 at the lower end of the backrest supporting arm 2. The ring member 54 is further fixedly connected to a predetermined point on the threaded rod 52 using a short pin 55.

Figure 3:
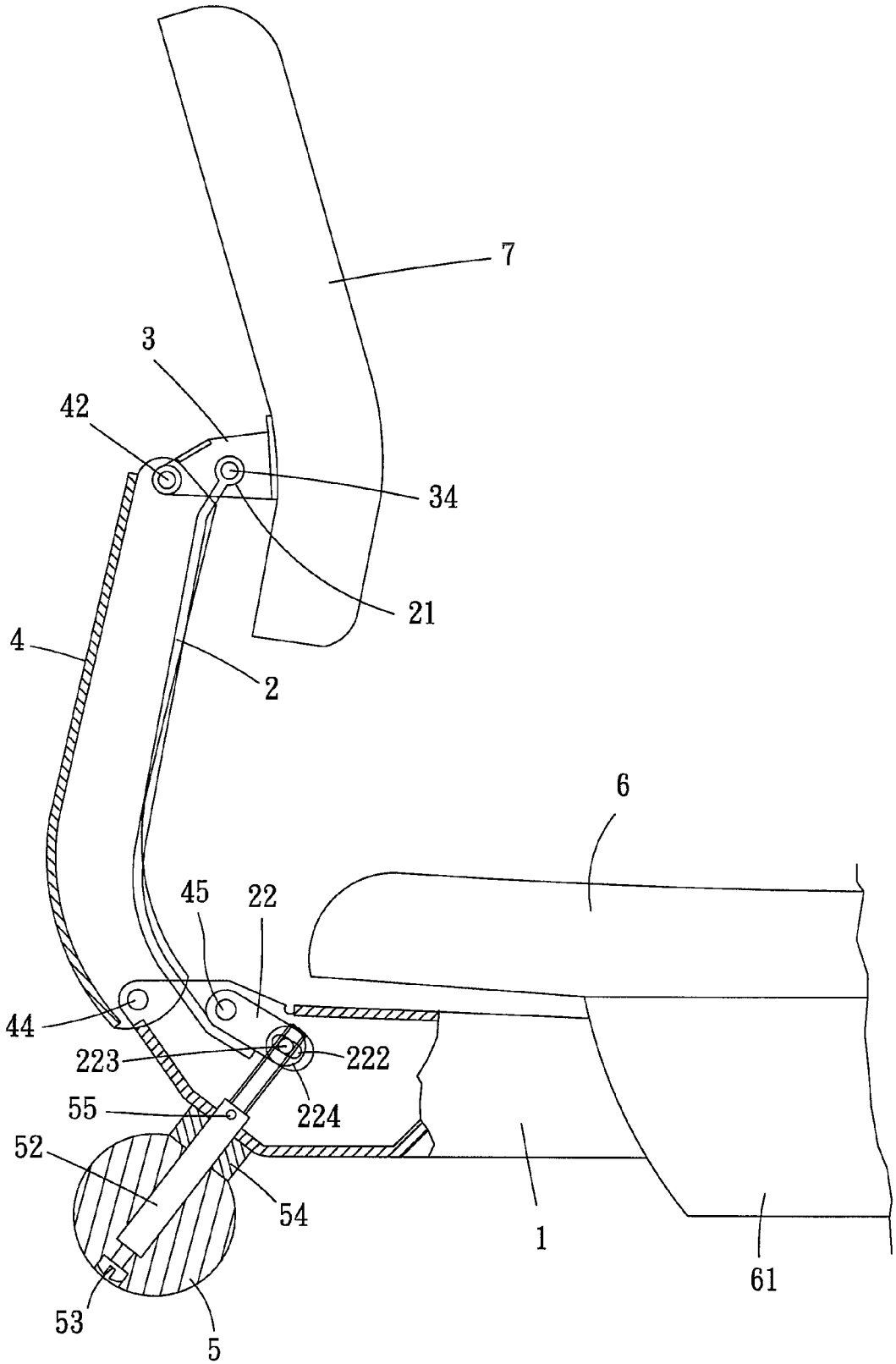
FIG. 3 is a sectioned side view of the adjustable chair backrest of the present invention at a non-adjusted position.
Figure 4:
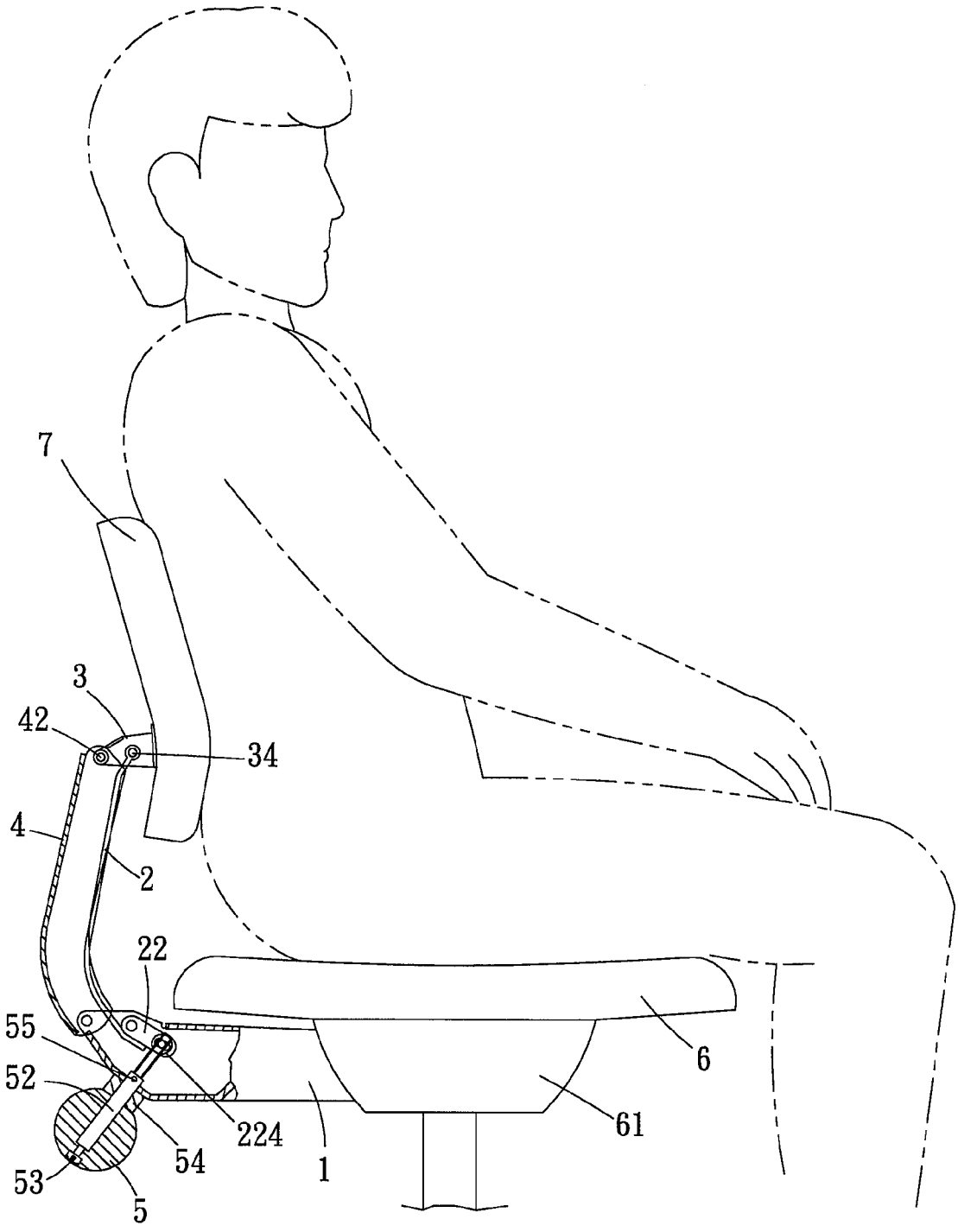
FIG. 4 shows the adjustable chair backrest of FIG. 3 in use.
Figure 5:
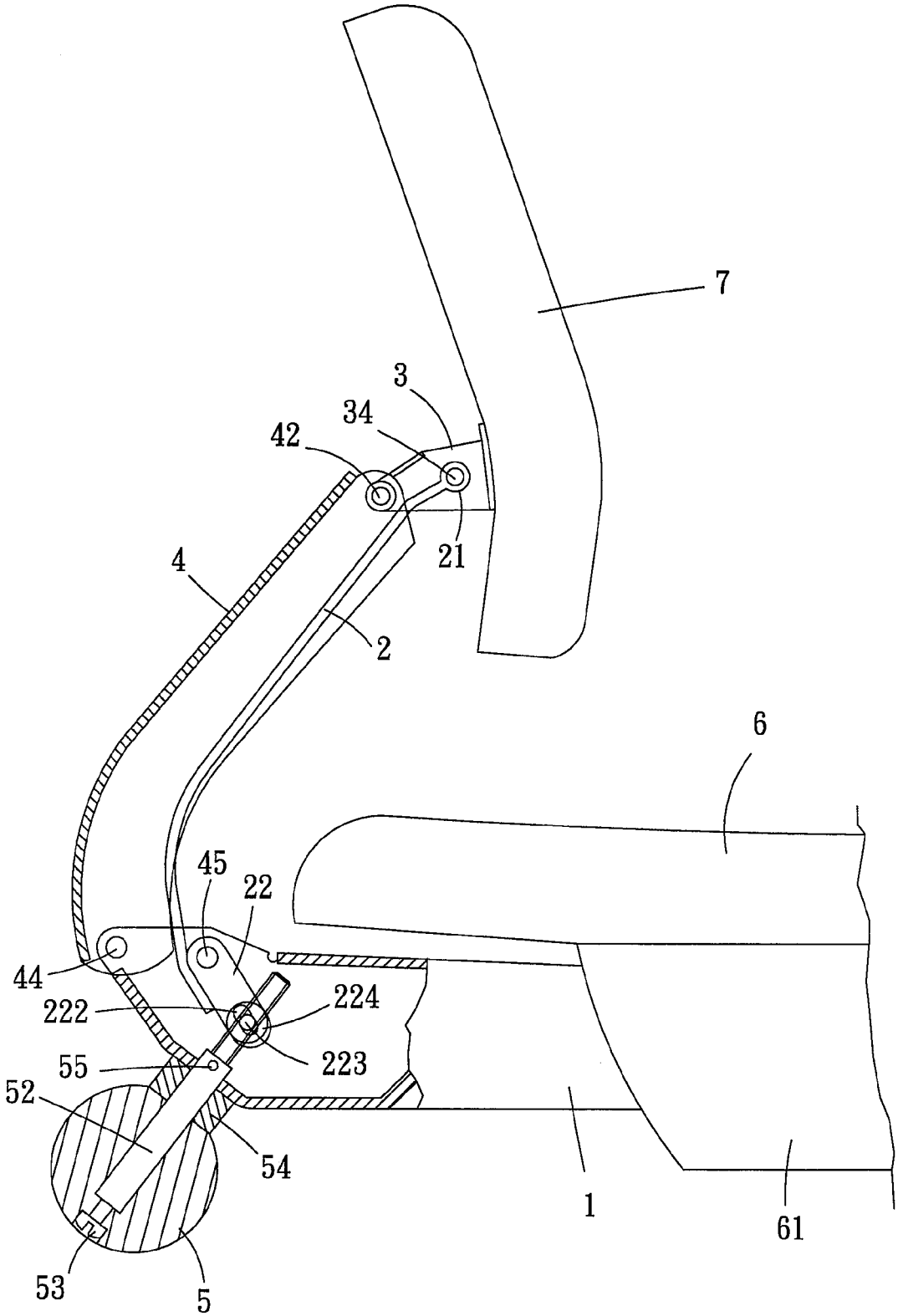
FIG. 5 is a sectioned side view showing the adjustable chair backrest of the present invention in a forward adjusted position.
Figure 6:
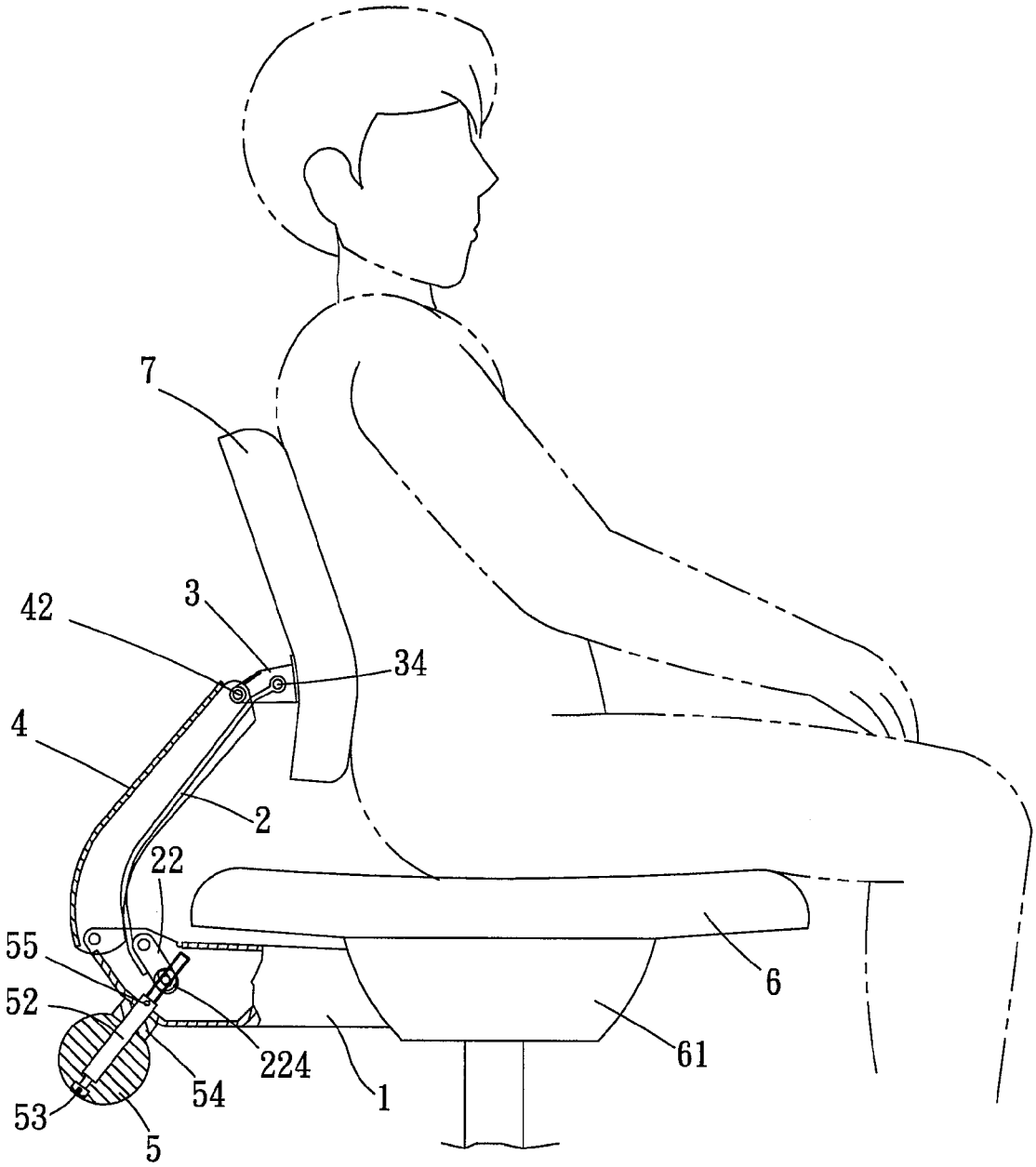
FIG. 6 shows the adjustable chair backrest of FIG. 5 in use.

Please refer to FIGS. 3 and 4. When the chair backrest 7 is in a non-adjusted position to locate completely behind the chair seat 6, the chair seat 6 has a large depth suitable for an adult to sit thereon. At this point, the front end of the threaded rod 52 is retracted in the internally threaded hole 2241 on the pivot shaft 224. Please refer to FIGS. 5 and 6. When it is desired to adjust the chair seat 6 to a small depth suitable for a child to sit thereon, simply turn the threaded rod 52 via the ball-shaped handle 5, so that the threaded rod 52 drives the pivot shaft 224 to move along the two oblong holes 222 on the two pivot brackets 22 of the backrest supporting arm 2. The more the threaded rod 52 is turned to project from the threaded hole 2241 on the pivot shaft 224, the more the backrest supporting arm 2 and the supporting arm cover 4 are tilted forward, bringing the chair backrest 7 to shift forward relative to the chair seat 6 until the chair seat has a reduced depth suitable for a child to sit thereon comfortably. When it is desired to adjust the chair seat 6 back to a depth suitable for an adult, simply turn the ball-shaped handle 5 in a reverse direction.

The curved long slot 113 formed on one sidewall of the hollow opening 11 at the rear end of the seat supporting frame 1 is provided on an outer side thereof with marks showing corresponding graduations. With the marks and graduations on the curved long slot 113, a user turning the ball-shaped handle 5 can easily and correctly adjust the chair backrest 7 forward or backward by a desired distance, so that the chair seat 6 may be adjusted to different depths according to the size of a user.

What is claimed is:

1. A chair backrest adjusting mechanism mounted to and between a chair seat and a chair backrest, comprising a seat supporting frame, a backrest supporting arm, a mount, a supporting arm cover, and a ball-shaped handle;

the seat supporting frame being connected at a front end to a base below the chair seat, and having a rear end formed into a hollow opening having two sidewalls, on which two sets of two shaft holes are correspondingly provided near upper edges thereof; and one of the two sidewalls of the hollow opening being provided with a curved long slot located lower than the two shaft holes on that sidewall;

the backrest supporting arm having an upper end provided with a transverse tubular joint for engaging with the mount, which is connected to a rear side of the chair backrest, and a lower end formed into a slightly bent section having a predetermined shape; two pivot brackets being correspondingly connected to and forward extended from two lateral sides of the bent section, and being provided with a shaft hole and an oblong hole each; a long shaft being extended through the shaft holes on the bent section and one of the two sets of shaft holes on the two sidewalls of the hollow opening of the seat supporting frame to pivotally connect the two pivot brackets to the two sidewalls of the hollow opening of the seat supporting frame; and, two short pins being extended through the oblong holes into two ends of a pivot shaft, so that the pivot shaft is mounted to and between the two pivot brackets; wherein the pivot shaft is provided at a middle point with an internally threaded hole;

the mount being connected at an inner end to a rear side of the chair backrest, and having an outer end formed with a recess, two sidewalls of which being correspondingly provided with a through hole and a shaft hole each; the shaft holes being located behind the through holes for a long shaft to extend therethrough into the tubular joint at the upper end of the backrest supporting arm;

the supporting arm cover being configured to fitly cover the backrest supporting arm, and being correspondingly provided at two lateral sides of an upper end with a shaft hole each, via which a long shaft is extended to engage with the two through holes at the two sidewalls of the recess on the mount to thereby connect the supporting arm cover to the mount; a lower end of the supporting arm cover being a slightly curved section with two sidewalls thereof correspondingly provided with a shaft hole, via which a long shaft is extended to engage with another set of shaft holes on the two sidewalls of the hollow opening of the seat supporting frame, so as to connect the supporting arm cover to the seat supporting frame; and the ball-shaped handle being used to control the forward and backward adjustment of the chair backrest, and being provided along an axis thereof with a central bore, in which an externally threaded rod is mounted; a screw being externally screwed into a rear end of the threaded rod to hold the threaded rod in the central bore; a front end of the threaded rod being extended through a ring member to mesh with the internally threaded hole on the pivot shaft mounted between the two pivot brackets at the lower end of the backrest supporting arm;

whereby when the chair backrest is adjusted to a forward position, the chair seat has a reduced depth suitable for a child to sit thereon; and when the chair backrest is adjusted from the forward position to a rearward non-adjusted position, the chair seat has an increased depth suitable for an adult to sit thereon.

* * * * *